US010361503B2

(12) United States Patent
Motohashi et al.

(10) Patent No.: US 10,361,503 B2
(45) Date of Patent: Jul. 23, 2019

(54) RESIN CONTAINING PACKING AND WATERPROOF CONNECTOR

(71) Applicant: YAZAKI CORPORATION, Tokyo (JP)

(72) Inventors: Yuuichirou Motohashi, Shizuoka (JP); Haruhiko Yokoyama, Shizuoka (JP); Takaaki Miyajima, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/000,866

(22) Filed: Jun. 5, 2018

(65) Prior Publication Data

US 2018/0366864 A1 Dec. 20, 2018

(30) Foreign Application Priority Data

Jun. 14, 2017 (JP) ..... 2017-116938

(51) Int. Cl.
*H01R 13/52* (2006.01)
*H01R 9/03* (2006.01)

(52) U.S. Cl.
CPC ..... *H01R 13/5208* (2013.01); *H01R 9/032* (2013.01)

(58) Field of Classification Search
CPC ..... H01R 13/5202; H01R 13/5205; H01R 13/5208; H01R 13/5219
USPC ..... 439/275, 587, 588, 733.1, 607.41
See application file for complete search history.

(56) References Cited

U.S. PATENT DOCUMENTS

| | | | | |
|---|---|---|---|---|
| 9,059,534 | B2 * | 6/2015 | Endo | H01R 13/52 |
| 9,929,491 | B2 * | 3/2018 | Yamaguchi | H01R 11/12 |
| 2014/0011401 | A1 | 1/2014 | Endo et al. | |
| 2014/0106588 | A1 * | 4/2014 | Suzuki | H01R 13/5219 439/271 |
| 2014/0287631 | A1 * | 9/2014 | Tashiro | H01R 13/521 439/733.1 |

FOREIGN PATENT DOCUMENTS

| | | |
|---|---|---|
| JP | 2010-153143 A | 7/2010 |
| JP | 2012-199051 A | 10/2012 |

* cited by examiner

*Primary Examiner* — Hien D Vu
(74) *Attorney, Agent, or Firm* — Kenealy Vaidya LLP

(57) ABSTRACT

A resin containing packing includes an elastic seal member and a resin member. The elastic seal member integrally includes an electric wire seal part in close-contact with an electric wire inserted into an attachment hole of equipment, an exterior seal part in close-contact with an inner circumferential surface of an exterior member which is mounted on an outer circumferential side of the electric wire seal part, and an equipment-side seal part in close-contact with an inner circumferential surface of the attachment hole. The resin member, is integrated with the elastic seal member, and integrally includes an exterior engaging part which is exposed from the outer circumferential surface of the elastic seal member to be positioned and engaged in the exterior member and an electric wire holding part which is exposed on an inner circumferential side of the equipment-side seal part to hold the electric wire.

7 Claims, 7 Drawing Sheets

RESIN CONTAINING PACKING AND WATERPROOF CONNECTOR

CROSS REFERENCE TO RELATED APPLICATIONS

This application is based on Japanese Patent Application (No. 2017-116938) filed on Jun. 14, 2017, the contents of which are incorporated herein by way of reference.

BACKGROUND

The present invention relates to a resin containing packing and a waterproof connector.

In a hybrid automobile or an electric automobile, a motor and an inverter are connected by a connector to be directly attached to equipment (for example, see JP-A-2010-153143 and JP-A-2012-199051).

As illustrated in FIG. 7, such a connector 501 includes an electric wire with terminal 503, a housing 505, a shield shell 507, a braid (shield conductor) 509, a rubber stopper 511, a shell packing 513, a unit packing 515, a rear holder 517, and a waterproof boot 539. In the electric wire with terminal 503, a terminal 519 is electrically connected with a conductor 523 of an electric wire 521. A terminal receiving chamber 525 is formed in the housing 505. In the terminal receiving chamber 525, the front side is opened as a terminal through hole 527, and the rear side is opened as a terminal insertion opening 529.

In the electric wire with terminal 503 inserted into the terminal receiving chamber 525, an electric contact part of the terminal 519 protrudes from the terminal through hole 527. The electric wire 521 is led out from the terminal insertion opening 529. A gap between the terminal insertion opening 529 and the electric wire 521 is watertightly sealed by the rubber stopper 511. The rear holder 517 regulates the separation of the rubber stopper 511 from the housing 505.

A cylindrical shield shell 507 is fitted in the outer circumference of the housing 505. An annular attachment step part 537 is formed in the outer circumferential surface of the housing 505. The shell packing 513 is mounted in the attachment step part 537. In the connector 501, the shell packing 513 watertightly seals a gap between the shield shell 507 and the housing 505 when the shield shell 507 is fitted into the outer circumference of the housing 505.

An annular circumferential groove 535 is formed in an attachment outer circumferential surface 533 of the housing 505. The unit packing 515 is mounted in the circumferential groove 535. In the connector 501, the attachment outer circumferential surface 533 of the housing 505 is inserted into an attachment hole of the equipment (not illustrated) in a fitting manner, so that the unit packing 515 is crimped on the inner circumferential surface of the attachment hole, and a gap between the housing 505 and the attachment hole of the equipment is sealed watertightly. Accordingly, the connector 501 prevents that the oil leaks from the equipment, and the water or the dust is infiltrated from the outside into the equipment.

SUMMARY

An object of the present invention is to provide a resin containing packing and a waterproof connector in which the number of components can be reduced, and a space can be saved.

The object of the invention will be achieved with the following configurations.

(1) A resin containing packing including:
- an elastic seal member which integrally includes
- an electric wire seal part configured to close-contact with an outer circumferential surface of an electric wire inserted into an attachment hole of equipment,
- an exterior seal part configured to close-contact with an inner circumferential surface of an exterior member which includes a fixing part to the equipment and is mounted on an outer circumferential side of the electric wire seal part, and
- an equipment-side seal part configured to close-contact with an inner circumferential surface of the attachment hole; and
- a resin member which is integrated with the elastic seal member and integrally includes
- an exterior engaging part which is exposed from the outer circumferential surface of the elastic seal member to be positioned and engaged in the exterior member, and
- an electric wire holding part which is exposed on an inner circumferential side of the equipment-side seal part to hold the electric wire.

(2) The resin containing packing according to (1), wherein the resin member includes a seal support part which is arranged between the electric wire seal part and the exterior seal part.

(3) The resin containing packing according to (2), wherein the seal support part includes annular part through which the electric wire is inserted, and the annular part is disposed on the outer circumferential side of the electric wire seal part.

(4) The resin containing packing according to (2), wherein the seal support part includes annular part through which the electric wire is inserted, and the annular part is disposed on an inner circumferential side of the exterior seal part.

(5) The resin containing packing according to (1), wherein the exterior engaging part is a flange part which protrudes along an outer circumferential surface of a main body of the resin member, and a tip of the flange part protrudes from between the exterior seal part and the equipment-side seal part in an axial direction of the electric wire on the outer circumferential surface of the elastic seal member.

(6) The resin containing packing according to any one of (1) to (5), wherein the resin member includes a boot holder locking part configured to lock a boot holder for holding a waterproof boot mounted in an outer circumferential part of the exterior member.

(7) A waterproof connector comprising:
- the resin containing packing according to (6);
- the exterior member made of a conductive material;
- a cylindrical shield conductor in which a terminal is electrically connected in the exterior member so as to cover the electric wire;
- a waterproof boot mounted in an outer circumferential part of the exterior member; and
- a boot holder for holding the waterproof boot, wherein
- the waterproof connector is inserted and fitted in the attachment hole.

DETAILED DESCRIPTION OF EXEMPLIFIED EMBODIMENTS

Figure 1:
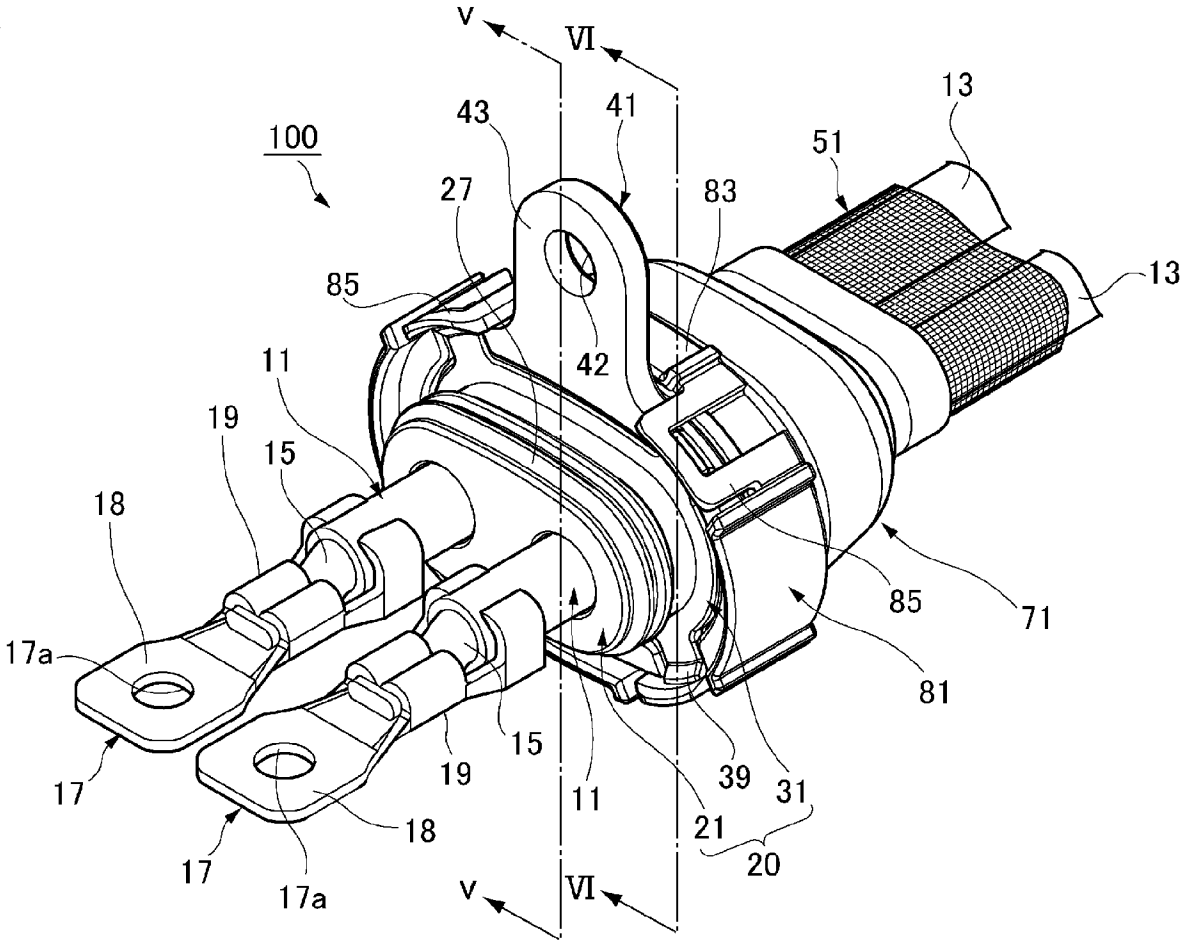
FIG. 1 is an overall perspective view of a waterproof connector according to one embodiment of the invention.

In the connector 501 of the related art which is to be directly attached to the equipment and has a waterproof function, the housing 505, the shield shell 507, the rubber stopper 511, the shell packing 513, the unit packing 515, the rear holder 517, the waterproof boot, and the like are necessary depending on the required function, and the number of components is increased. For this reason, the component costs and the processing costs (the assembly costs of the component) of the connector 501 are increased. Further, since an attachment space (the terminal insertion opening 529, the circumferential groove 535, and the attachment step part 537) is necessary for each of the seal components such as the rubber stopper 511, the shell packing 513, and the unit packing 515 used in a watertight seal structure, there is a limit to the miniaturization of the connector 501 in the case of the existing structure.

The invention has been made in consideration of the above situation, and an object thereof is to provide a resin containing packing and a waterproof connector in which the number of components can be reduced, and a space can be saved.

Hereinafter, one embodiment according to the invention will be described with reference to the drawings.

Figure 2:
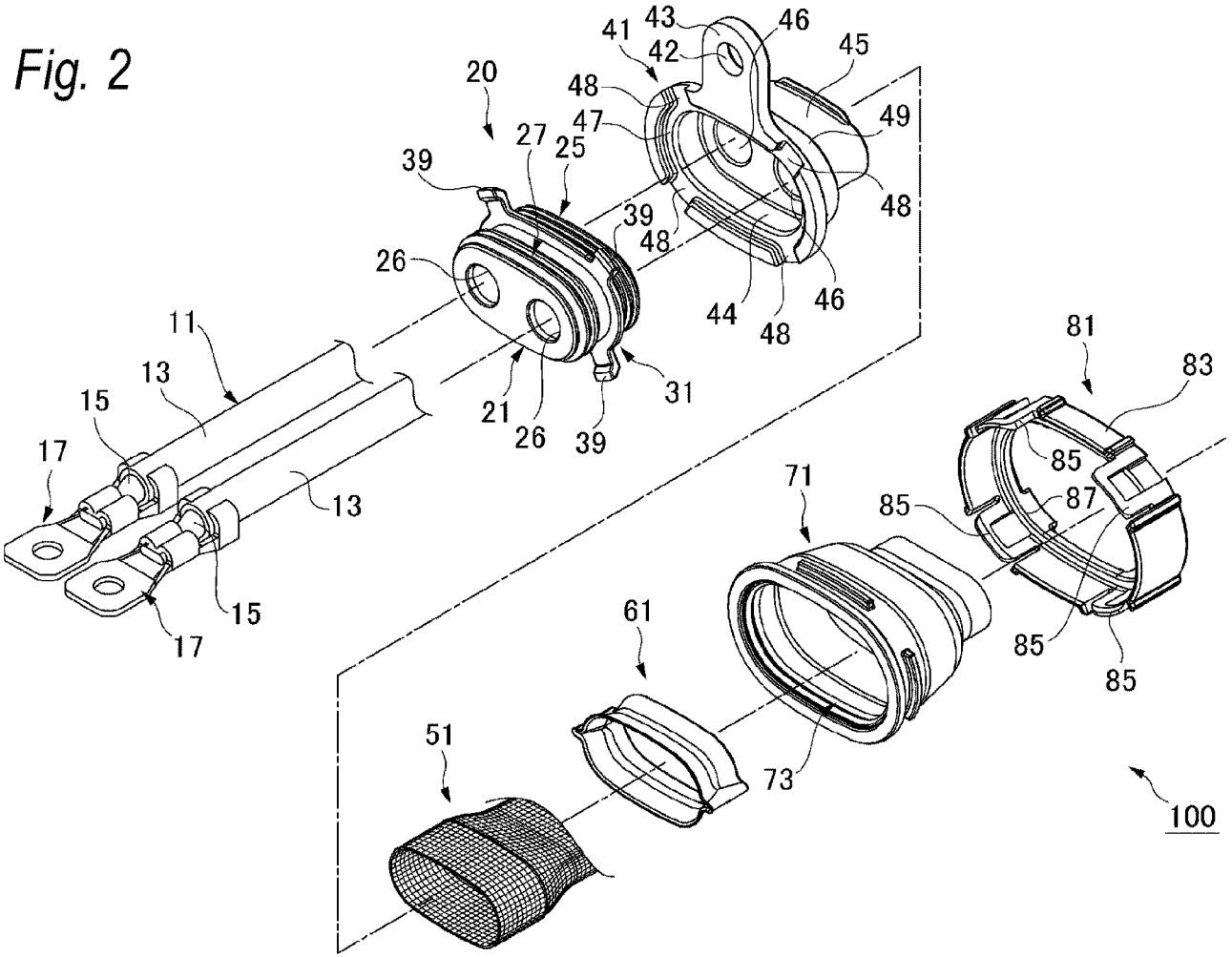
FIG. 2 is an exploded perspective view of the waterproof connector illustrated in FIG. 1.

FIGS. 1 and 2 are an overall perspective view and an exploded perspective view illustrating a waterproof connector 100 according to the embodiment of the invention.

The waterproof connector 100 according to this embodiment is a waterproof connector which is directly attached to equipment to electrically connect an inverter, a motor, and the like which are vehicle-mounted electric equipment (hereinafter, simply referred to as "equipment".) of an electric automobile or a hybrid automobile. In the motor mounted in the hybrid automobile or the electric automobile, the large current is supplied from the inverter and the like to exhibit a high driving torque. Typically, in an electric wire 11 which connects the inverter and the motor, the transmission loss is small. Thus, the electric wire having a large diameter (thick electric wire) is used in which a conductor diameter is large, and the circumference of the conductor is covered with the insulating coating having a high insulation performance. Preferably, the waterproof connector 100 is used in a structure in which the electric wire 11 having a large diameter is directly attached in the attachment hole of the equipment.

Incidentally, in this embodiment, an inserting direction of the waterproof connector 100 with respect to the attachment hole 200 is set as the front side of the connector, and an extraction direction is set as the rear side of the connector.

As illustrated in FIGS. 1 and 2, the waterproof connector 100 according to this embodiment includes two electric wires 11, a resin containing packing 20, a shield shell 41 which is an exterior member formed by a conductive material, a braid 51 which is a cylindrical shield conductor in which the terminal is electrically connected in the shield shell 41 to cover the electric wire 11, a waterproof boot 71 which is mounted in an outer circumferential part 49 of the shield shell 41, and a boot holder 81 for holding the waterproof boot 71. In addition, a number of the electric wire 11 may be one, three or more.

Figure 5:
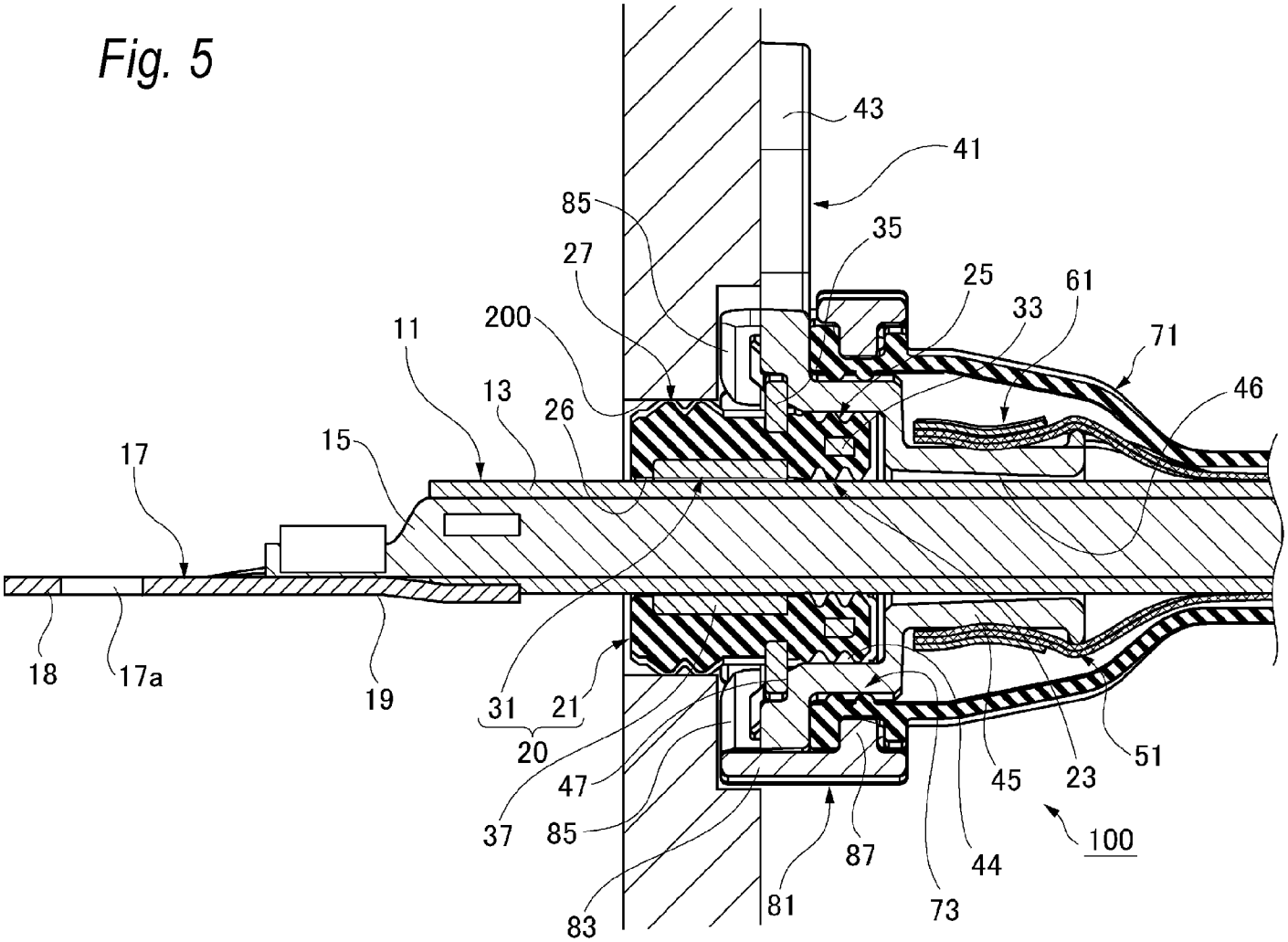
FIG. 5 is a sectional view taken along line V-V and illustrating a state where the waterproof connector illustrated in FIG. 1 is directly attached to an attachment hole of equipment.
Figure 6:
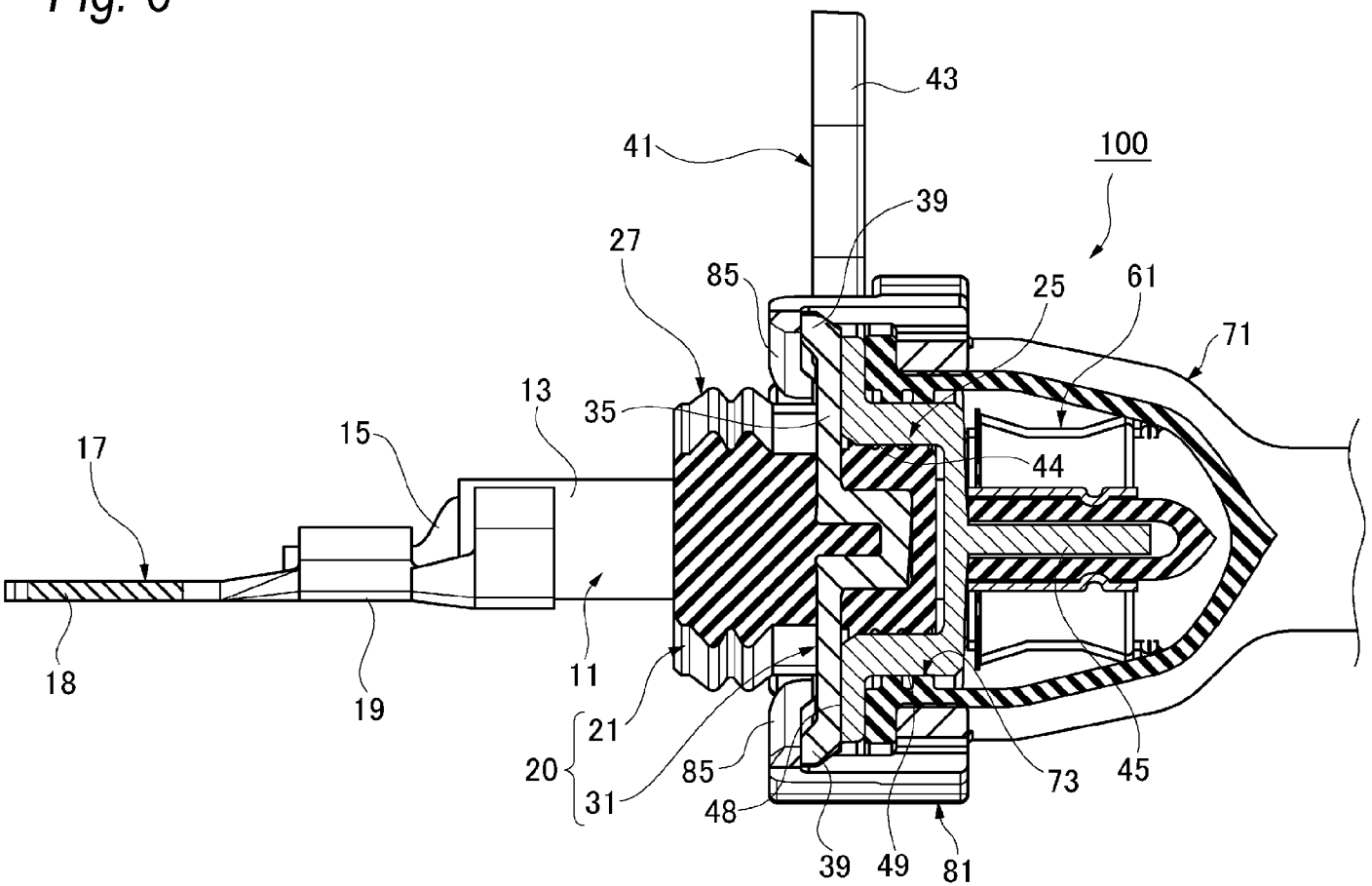
FIG. 6 is a sectional view of the waterproof connector taken along line VI-VI illustrated in FIG. 1.

The terminal of the electric wire 11 is connected in the terminal 17, and the electric wire is inserted into the attachment hole 200 of the equipment (see FIG. 5). The electric wire 11 is the above-described electric wire having a large diameter (so called thick electric wire) for the large current, and includes a conductor 15, and an outer coating 13 which coats the conductor 15 in an insulating manner. In the conductor 15, a core wire is used which is made of a copper (including a tin-plated copper wire), aluminum, aluminum alloy, or the like. The core wire is not only made as a solid wire, but also may be made of parallel plural wires or by stranding plural wires. In the terminal 17, one end in a longitudinal direction is set as a conductor connection part 19, and the other end in the longitudinal direction is set as a terminal contact part 18. A fastening hole 17*a* for connection with the equipment-side terminal is drilled in the terminal contact part 18. The conductor 15 is crimp-connected in the conductor connection part 19 of the terminal 17.

Figure 3:
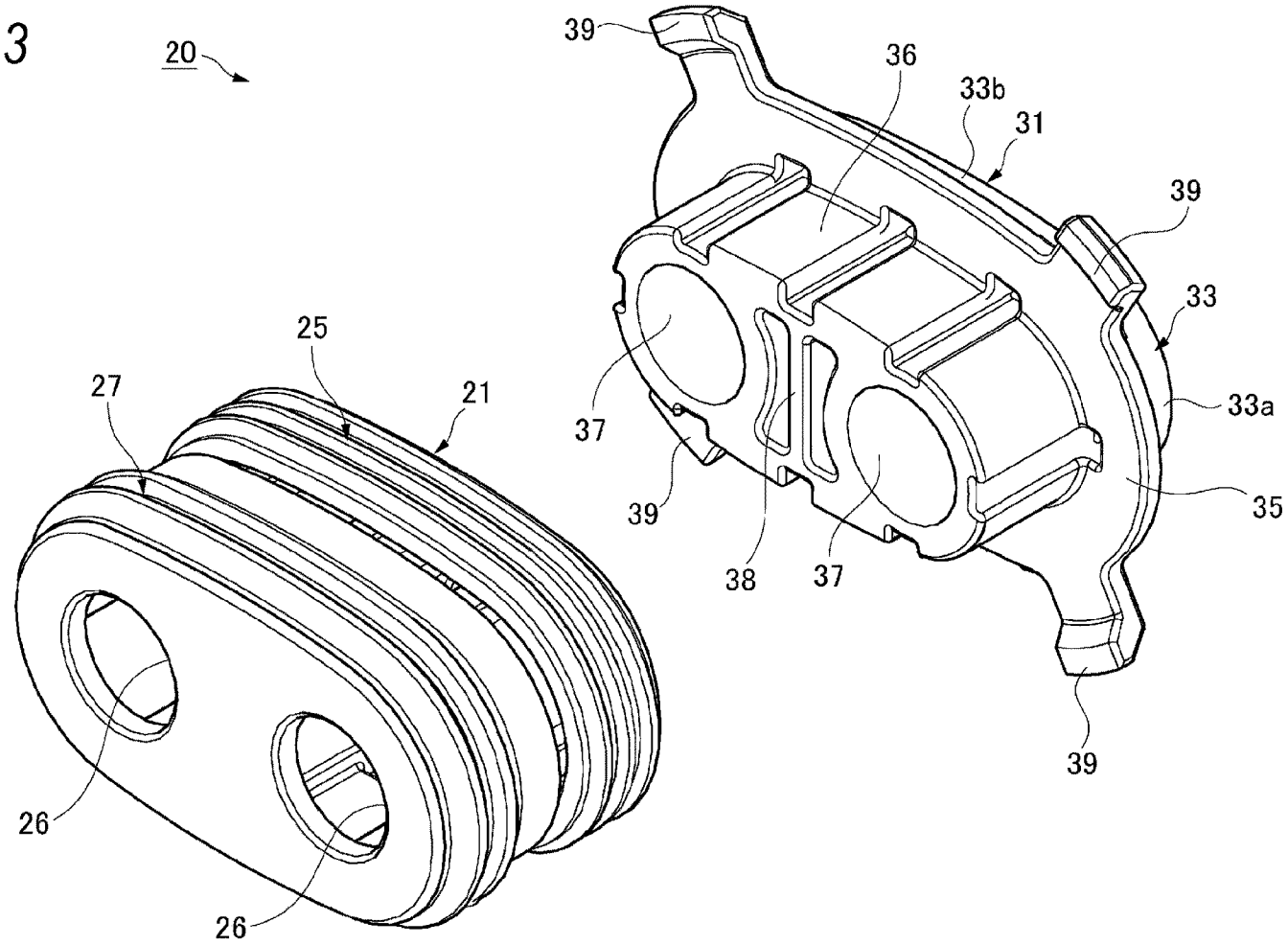
FIG. 3 is a perspective view separately illustrating an elastic seal member and a resin member in a resin containing packing illustrated in FIG. 2.
Figure 4:
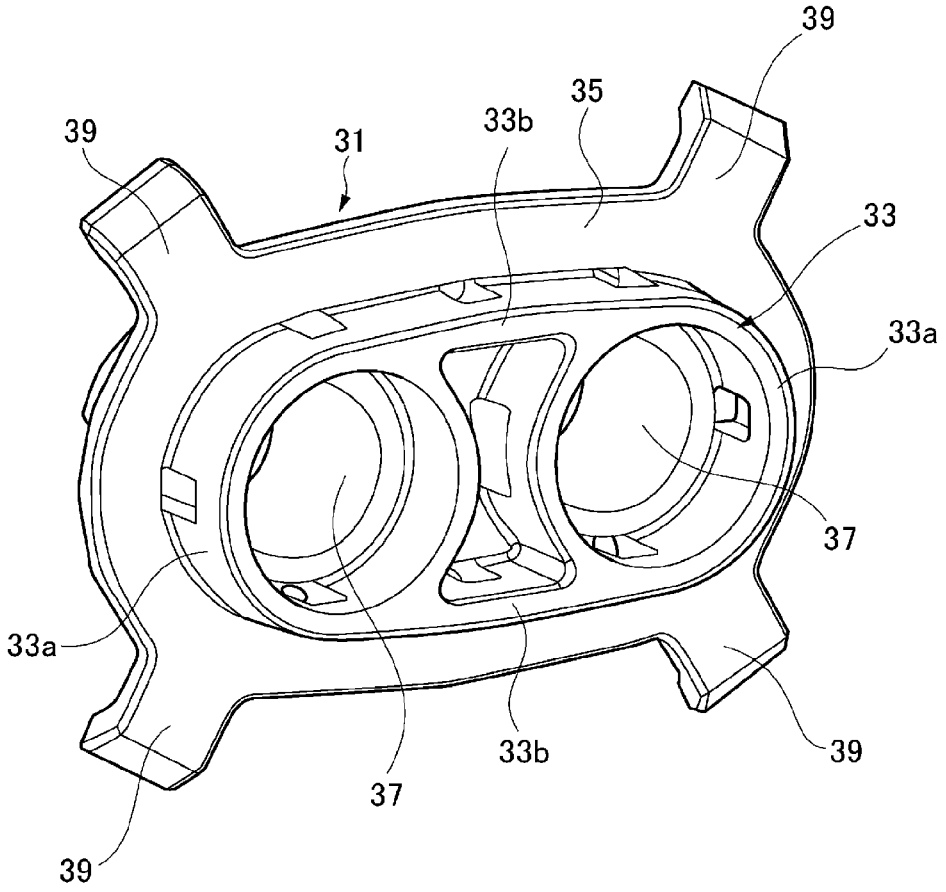
FIG. 4 is a perspective view on a back surface side of the resin member illustrated in FIG. 3.

As illustrated in FIG. 3, the resin containing packing 20 according to this embodiment includes an elastic seal member 21 which is made of an elastic material such as a rubber, and a resin member 31 which is integrated with the elastic seal member 21 and is made of a synthetic resin. The resin member 31 is integrated with the elastic seal member 21 by insert-molding, for example.

As illustrated in FIGS. 3 and 5, a pair of electric wire insertion holes 26 are penetrated in the elastic seal member 21 formed in a substantially elliptic cylinder shape in an axial direction. An electric wire seal part 23 in close-contact with the outer circumferential surface of the electric wire 11 is formed in the rear inner circumferential surface of the electric wire insertion hole 26. An exterior seal part 25 in close-contact with the inner circumferential surface of the shield shell 41 mounted on the outer circumference of the electric wire seal part 23 is formed in the rear outer circumferential surface of the elastic seal member 21. Further, an equipment-side seal part 27 in close-contact with the inner circumferential surface of the attachment hole 200 is formed in the front outer circumferential surface of the elastic seal member 21. That is, in the elastic seal member 21, the electric wire seal part 23, the exterior seal part 25, and the equipment-side seal part 27 are formed integrally.

As illustrated in FIGS. 3 to 6, a seal support part 33 arranged between the electric wire seal part 23 and the exterior seal part 25, an exterior engaging part 35 which is exposed in the outer circumferential surface of the elastic seal member 21 and is engaged to be positioned in the shield shell 41, an electric wire holding part 37 which is exposed in the front inner circumferential surface of the electric wire insertion hole 26 on the inner circumferential side of the equipment-side seal part 27 to hold the electric wire 11, and a boot holder locking part 39 which locks the boot holder 81 for holding the waterproof boot 71 mounted in the outer circumferential part 49 of the shield shell 41 are formed integrally in the resin member 31.

The seal support part 33 includes a pair of annular parts 33*a* which protrude from the rear end side of a main body 36 formed in a substantially elliptic cylinder shape such that the electric wires 11 are inserted thereinto, and a pair of connection parts 33*b* which connect each of upper and lower outer circumferential surfaces of the annular parts 33*a*.

The annular part 33*a* is disposed on the outer circumferential side of the electric wire seal part 23, so as to support the counterforce in a diameter increasing direction which acts on the electric wire seal part 23 from the outer circumferential surface of the electric wire 11. The electric wire seal part 23 can apply a proper seal pressure to the outer circumferential surface of the electric wire 11. Further, the annular part 33*a* and the connection part 33*b* are disposed on the inner circumferential side of the exterior seal part 25, so as to support the counterforce in a diameter decreasing direction which acts on the exterior seal part 25 from an inner circumferential surface 44 of the shield shell 41. The exterior seal part 25 can apply a proper seal pressure to the inner circumferential surface 44 of the shield shell 41.

In addition, in a case that the number of the electric wire 11 is one, the seal support part 33 may include one annular part 33*a* without the connecting part 33*b*. In this case, the annular part 33*a* is disposed on the inner circumferential side of the exterior seal part 25, so as to support the counterforce in a diameter decreasing direction which acts on the exterior seal part 25 from an inner circumferential surface 44 of the shield shell 41.

The exterior engaging part 35 is a flange part which protrudes along the outer circumferential surface of the main body 36, and a flange tip protrudes from between the exterior seal part 25 and the equipment-side seal part 27 in the axial direction on the outer circumferential surface of the elastic seal member 21. The exterior engaging part 35 which protrudes from the outer circumferential surface of the elastic seal member 21 is fitted into a positioning step part 47 of the shield shell 41, and the resin containing packing 20 is positioned with respect to the shield shell 41.

The electric wire holding part 37 is a pair of cylindrical parts which extend from a front wall 38 of the main body 36 to the rear side to be connected in the annular part 33*a*, and the cylindrical inner wall is exposed from the front inner circumferential surface of the electric wire insertion hole 26 in the elastic seal member 21. That is, the electric wire holding part 37 which is exposed on the inner circumferential side of the equipment-side seal part 27 in the elastic seal member 21 can hold the electric wire 11 which is inserted into the electric wire insertion hole 26. Accordingly, the electric wire 11 is positioned and held with respect to the shield shell 41 through the resin containing packing 20.

The boot holder locking parts 39 are four locking protrusions which protrude radially from the exterior engaging part 35 to the outside, and the tip part which protrudes to the outer circumferential side from the shield shell 41 locks the lock arm 85 of the boot holder 81. Accordingly, the boot holder 81 which holds the waterproof boot 71 is held in the shield shell 41 through the resin containing packing 20.

The shield shell 41 is an exterior member which is formed of a conductive material. The shield shell 41 is connected in an earth circuit on the equipment side when a fixing part 43 is fastened in the casing of the equipment by a bolt and the like. Accordingly, it is possible to block (shield) an electromagnetic wave from the conductor 15 which is inserted to the resin containing packing 20. However, in the waterproof connector according to the invention, the conductivity of the exterior member is not an essential requirement. In a case where a shield function is not required for the waterproof connector, the exterior member may be made of a synthetic resin.

The shield shell 41 is formed in an elliptic annular shape, and is mounted in the exterior seal part 25 by fitting the outer circumference of the elastic seal member 21 of the resin containing packing 20 inward. The exterior seal part 25 of the elastic seal member 21 seals a gap from the inner circumferential surface 44 of the shield shell 41 in a waterproof manner, so as to secure the watertightness.

The fixing part 43 for fixation to the casing of the equipment is formed on the outer circumferential side of the shield shell 41. In the fixing part 43, a bolt fixing hole 42 is drilled in a fixation piece projecting outward.

The positioning step part 47 in which the exterior engaging part 35 in the resin member 31 of the resin containing packing 20 is fitted is formed in the front end of the shield shell 41. The shield shell 41 positions the resin containing packing 20 by fitting the exterior engaging part 35 in the positioning step part 47. Further, a groove 48 which is connected to the outer circumferential end continuously with the positioning step part 47 is formed in the front end of the shield shell 41. The groove 48 is a groove which receives the boot holder locking part 39 protruding from the exterior engaging part 35 to avoid the interference with the shield shell 41.

A pair of electric wire penetration holes 46 into which the electric wires 11 are loosely fitted, and a fixing cylinder part 45 for fixing the terminal, which covers the electric wire 11, of the cylindrical braid 51 in the shield shell 41 are formed on the rear end side of the shield shell 41. The terminal of the braid 51 attached in the outer circumference of the fixing cylinder part 45 is caulked and fixed in a caulking ring 61. Incidentally, the cylindrical shield conductor is not limited to the braid 51, but may be configured such that a cylindrical metal foil or a sheet-shaped metal foil is wound on the electric wire 11.

The waterproof boot 71 is made of an elastic material such as silicon, the rubber, and soft resin. The waterproof boot 71 is mounted in the outer circumferential part 49 of the shield shell 41, so as to cover and waterproof the fixing part of the shield shell 41 and the terminal of the braid 51. A shell-side seal part 73 is formed in the inner circumferential surface of the waterproof boot 71. The shell-side seal part 73 seals a gap from the outer circumferential part 49 of the shield shell 41 in a waterproof manner, so as to secure the watertightness.

The boot holder 81 includes an annular main body 83 externally fitted in the outer circumferential part of the waterproof boot 71, a lock rib 87 which protrudes from the inner circumferential surface of the annular main body 83 to be locked in the outer circumferential part of the waterproof boot 71, and four lock arms 85 which protrude from the annular main body 83 to the front side. The boot holder 81 locks the lock arm 85 in the boot holder locking part 39 of the resin containing packing 20 in a state where the lock rib 87 is locked in the outer circumferential part of the waterproof boot 71. Therefore, the waterproof boot 71 is held in the shield shell 41 through the boot holder 81 and the resin containing packing 20.

Next, the description will be given about the operation of the above-described configuration.

In the resin containing packing 20 according to this embodiment, the electric wire seal part 23 in close-contact with the outer circumferential surface of the electric wire 11, the exterior seal part 25 in close-contact with the inner circumferential surface 44 of the shield shell 41, and the equipment-side seal part 27 in close-contact with the inner circumferential surface of the attachment hole 200 are integrally formed in the elastic seal member 21. In this regard, it is not necessary to separately prepare the seal components such as the rubber stopper 511, the shell packing 513, and the unit packing 515 used in the watertight seal structure of the related art illustrated in FIG. 7.

The exterior engaging part 35 of the resin member 31 exposed from the outer circumferential surface of the elastic seal member 21 is positioned and engaged in the shield shell 41, and the electric wire holding part 37 of the resin member 31 exposed on the inner circumferential side of the equipment-side seal part 27 holds the electric wire 11. That is, the electric wire 11 is positioned and held with respect to the attachment hole 200 of the equipment when the fixing part 43 of the shield shell 41 is fixed in the equipment. In this regard, it is possible to eliminate the housing 505 (see FIG. 7) of the related art for positioning and holding the electric wire 521 with respect to the attachment hole of the equipment.

Therefore, in the resin containing packing 20 in which the resin member 31 is integrated in the elastic seal member 21 by insert-molding, the number of the seal components used in the watertight seal structure can be reduced, the component costs and the assembly costs can be reduced, and further the attachment space of each of the seal components can be reduced to save a space.

In the resin containing packing 20 of this embodiment, the seal support part 33 of the resin member 31 which is arranged between the electric wire seal part 23 and the exterior seal part 25 supports the counterforce acting on the seal parts, so as to properly manage the seal pressure of the electric wire seal part 23 and the exterior seal part 25 which are formed integrally.

In the resin containing packing 20 of this embodiment, the boot holder locking part 39 is integrally provided in the resin member 31, and thus the waterproof boot 71 can be easily mounted in the outer circumferential part 49 of the shield shell 41.

Figure 7:
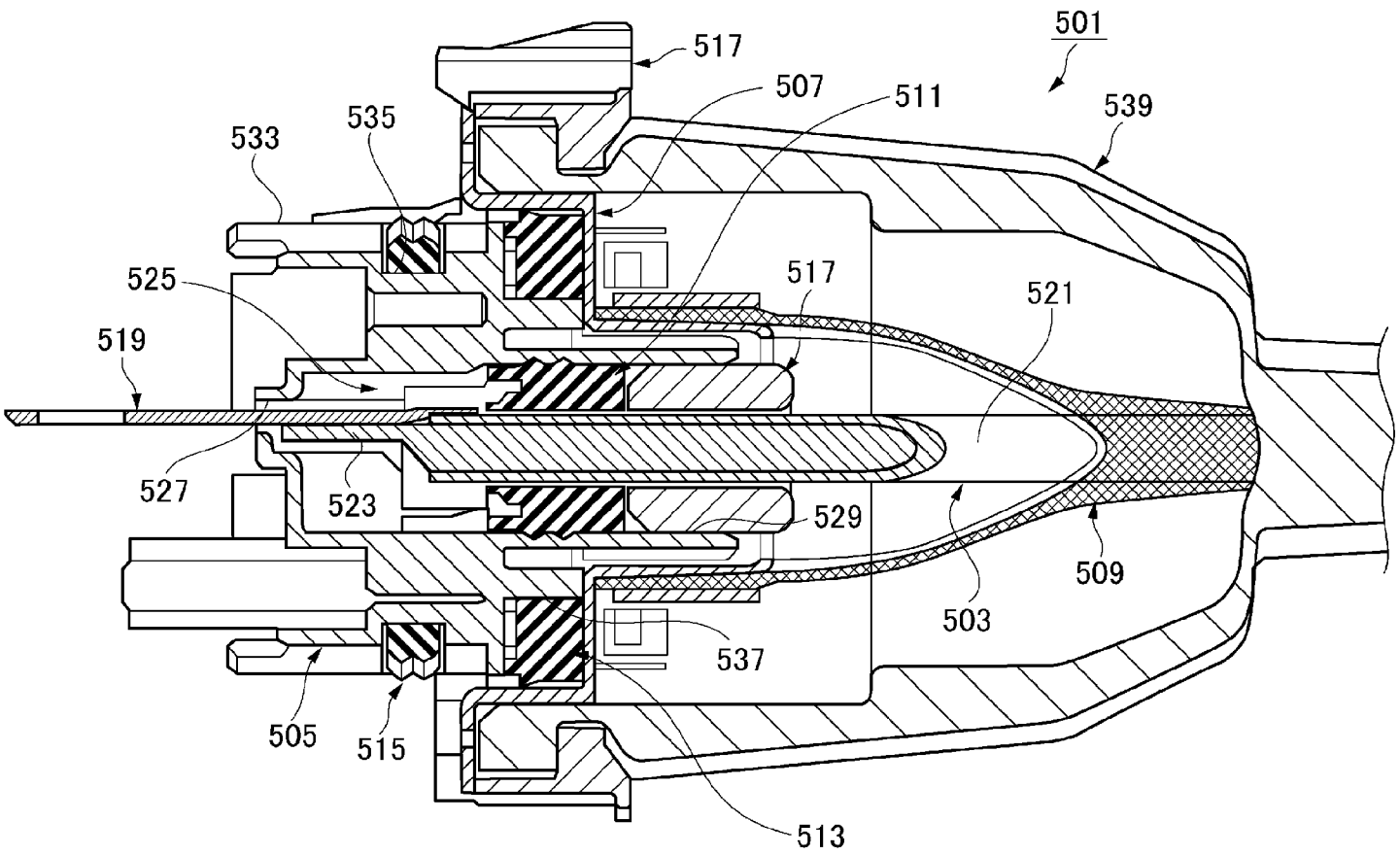
FIG. 7 is a longitudinal sectional view of the waterproof connector of the related art.

In the waterproof connector 100 according to this embodiment, by using the resin containing packing 20 in which the resin member 31 is integrated with the elastic seal member 21, it is not necessary to separately prepare the seal components such as the rubber stopper 511, the shell packing 513, and the unit packing 515, and the housing 505 used in the connector 501 of the related art illustrated in FIG. 7. Therefore, the number of the seal components used in the watertight seal structure can be reduced, the component costs and the assembly costs can be reduced, and further the attachment space of each of the seal components can be reduced to save a space. Thus, the waterproof connector 100 can be miniaturized.

Incidentally, the invention is not limited to the above-described embodiments, and a modification, a variation or the like is allowed appropriately. In addition, material, shape, size, number, location or the like of each component in the above-described embodiments is arbitrary and not limited as long as they can attain the invention.

Herein, the features of the above-described embodiments of the resin containing packing and the waterproof connector according to the invention will be simply summarized as the following [1] to [7].

[1] A resin containing packing (20) including:

an elastic seal member (21) which integrally includes an electric wire seal part (23) configured to close-contact with an outer circumferential surface of an electric wire (13) inserted into an attachment hole (200) of equipment, an exterior seal part (25) configured to close-contact with an inner circumferential surface (44) of an exterior member (shield shell 41) which includes a fixing part (43) to the equipment and is mounted on an outer circumferential side of the electric wire seal part (23), and an equipment-side seal part (27) configured to close-contact with an inner circumferential surface of the attachment hole (200); and a resin member (31) which is integrated with the elastic seal member (21) and integrally includes an exterior engaging part (35) which is exposed from the outer circumferential surface of the elastic seal member (21) to be positioned and engaged in the exterior member (shield shell 41), and an electric wire holding part (37) which is exposed on an inner circumferential side of the equipment-side seal part (27) to hold the electric wire (11).

[2] The resin containing packing (20) according to [1], wherein the resin member (31) includes a seal support part (33) which is arranged between the electric wire seal part (23) and the exterior seal part (25).

[3] The resin containing packing according to [2], wherein the seal support part (33) includes annular part (33*a*) through which the electric wire (13) is inserted, and the annular part (33*a*) is disposed on the outer circumferential side of the electric wire seal part (23).

[4] The resin containing packing according to [2], wherein the seal support part (33) includes annular part (33*a*) through which the electric wire (13) is inserted, and the annular part (33*a*) is disposed on an inner circumferential side of the exterior seal part (25).

[5] The resin containing packing according to [1], wherein the exterior engaging part (35) is a flange part which protrudes along an outer circumferential surface of a main body (36) of the resin member (31), and a tip of the flange part protrudes from between the exterior seal part (25) and the equipment-side seal part (27) in an axial direction of the electric wire (13) on the outer circumferential surface of the elastic seal member (21).

[6] The resin containing packing (20) according to any one of [1] to [5], wherein the resin member (31) includes a boot holder locking part (39) configured to lock a boot holder (81) for holding a waterproof boot (71) mounted in an outer circumferential part of the exterior member (shield shell 41).

[7] A waterproof connector (100) including:

the resin containing packing (20) according to [6];

the exterior member (shield shell 41) made of a conductive material;

a cylindrical shield conductor (braid 51) in which a terminal is electrically connected in the exterior member (shield shell 41) so as to cover the electric wire (11);

a waterproof boot (71) mounted in an outer circumferential part (49) of the exterior member (shield shell 41); and a boot holder (81) for holding the waterproof boot (71), wherein the waterproof connector is inserted and fitted in the attachment hole (200).

According to the resin containing packing, the electric wire seal part in close-contact with the outer circumferential surface of the electric wire, the exterior seal part in close-contact with the inner circumferential surface of the exterior member, and the equipment-side seal part in close-contact with the inner circumferential surface of the attachment hole are integrally formed in the elastic seal member. In this regard, it is not necessary to separately prepare the seal components such as the rubber stopper, the shell packing, and the unit packing used in the watertight seal structure of the related art illustrated in FIG. 7.

Further, the exterior engaging part of the resin member exposed in the outer circumferential surface of the elastic seal member is positioned and engaged in the exterior member, and the electric wire holding part of the resin member exposed on the inner circumferential side of the equipment-side seal part holds the electric wire. That is, the electric wire is positioned and held with respect to the attachment hole of the equipment when the fixing part of the exterior member is fixed in the equipment. In this regard, it is possible to eliminate the housing of the related art for positioning and holding the electric wire with respect to the attachment hole of the equipment.

Therefore, in the resin containing packing in which the resin member is integrated in the elastic seal member, the number of the seal components used in the watertight seal structure can be reduced, the component costs and the assembly costs can be reduced, and further the attachment space of each of the seal components can be reduced to save a space.

According to the resin containing packing, the seal support part of the resin member which is arranged between the electric wire seal part and the exterior seal part supports the counterforce acting on the seal parts, so as to properly manage the seal pressure of the electric wire seal part and the exterior seal part which are formed integrally.

According to the resin containing packing, the boot holder locking part is integrally provided in the resin member, and thus the waterproof boot can be easily mounted in the outer circumferential part of the exterior member.

According to the waterproof connector, by using the resin containing packing in which the resin member is integrated with the elastic seal member, it is not necessary to separately prepare the seal components such as the rubber stopper, the shell packing, and the unit packing, and the housing used in the waterproof connector of the related art.

Therefore, the number of the seal components used in the watertight seal structure can be reduced, the component costs and the assembly costs can be reduced, and further the attachment space of each of the seal components can be reduced to save a space. Thus, the waterproof connector can be miniaturized.

In the resin containing packing and the waterproof connector according to the invention, the number of components can be reduced, and a space can be saved.

What is claimed is:

1. A resin containing packing comprising:

an elastic seal member which integrally includes an electric wire seal part configured to close-contact with an outer circumferential surface of an electric wire inserted into an attachment hole of equipment, an exterior seal part configured to close-contact with an inner circumferential surface of an exterior shield shell which includes a fixing part to the equipment and is mounted on an outer circumferential side of the electric wire seal part, and an equipment-side seal part configured to close-contact with an inner circumferential surface of the attachment hole of the equipment; and a resin member which is mounted in the elastic seal member and integrally includes an exterior engaging part which is exposed from the outer circumferential surface of the elastic seal member to be positioned and engaged in the exterior shield shell, and an electric wire holding part which is extended from the exterior engaging part and exposed on an inner circumferential side of the equipment-side seal part to hold the electric wire.

2. The resin containing packing according to claim 1, wherein the resin member includes a seal support part which is arranged between the electric wire seal part and the exterior seal part.

3. The resin containing packing according to claim 2, wherein the seal support part includes annular part through which the electric wire is inserted, and the annular part is disposed on the outer circumferential side of the electric wire seal part.

4. The resin containing packing according to claim 2, wherein the seal support part includes annular part through which the electric wire is inserted, and the annular part is disposed on an inner circumferential side of the exterior seal part.

5. The resin containing packing according to claim 1, wherein the exterior engaging part is a flange part which protrudes along an outer circumferential surface of a main body of the resin member, and a tip of the flange part protrudes from between the exterior seal part and the equipment-side seal part in an axial direction of the electric wire on the outer circumferential surface of the elastic seal member.

6. The resin containing packing according to claim 1, wherein the resin member includes a boot holder locking part configured to lock a boot holder for holding a waterproof boot mounted in an outer circumferential part of the exterior member.

7. A waterproof connector comprising:

the resin containing packing according to claim 6;

the exterior member made of a conductive material;

a cylindrical shield conductor in which a terminal is electrically connected in the exterior member so as to cover the electric wire;

a waterproof boot mounted in an outer circumferential part of the exterior member; and a boot holder for holding the waterproof boot, wherein the waterproof connector is inserted and fitted in the attachment hole.

* * * * *